US009821481B2

(12) United States Patent
Miyawaki

(10) Patent No.: US 9,821,481 B2
(45) Date of Patent: Nov. 21, 2017

(54) SAW SHEATH, AND STORAGE STRUCTURES OF SAW SHEATH AND SAW

(75) Inventor: Shozo Miyawaki, Hyogo (JP)

(73) Assignee: U.M. KOGYO INC., Hyogo (JP)

( * ) Notice: Subject to any disclaimer, the term of this patent is extended or adjusted under 35 U.S.C. 154(b) by 280 days.

(21) Appl. No.: 14/115,367

(22) PCT Filed: Apr. 5, 2012

(86) PCT No.: PCT/JP2012/059334

§ 371 (c)(1),
(2), (4) Date: Nov. 4, 2013

(87) PCT Pub. No.: WO2012/153584

PCT Pub. Date: Nov. 15, 2012

(65) Prior Publication Data

US 2014/0059870 A1 Mar. 6, 2014

(30) Foreign Application Priority Data

May 11, 2011 (WO) ..... PCT/JP2011/06081
Jul. 25, 2011 (WO) ..... PCT/JP2011/066823
Jul. 28, 2011 (WO) ..... PCT/JP2011/067271

(51) Int. Cl.
*B26B 29/02* (2006.01)
*B26B 29/00* (2006.01)
*B27B 21/00* (2006.01)

(52) U.S. Cl.
CPC ..... *B26B 29/00* (2013.01); *B26B 29/025* (2013.01); *B27B 21/00* (2013.01)

(58) Field of Classification Search
CPC ..... B26B 29/02; B26B 29/025
USPC ..... 224/232, 242, 904; 30/143, 151
See application file for complete search history.

(56) References Cited

U.S. PATENT DOCUMENTS 4,190,955 A * 3/1980 Rushforth ..... A63B 57/0037 224/666
5,926,959 A * 7/1999 Collins ..... B26B 29/025 224/232
2004/0244119 A1* 12/2004 Terzuola ..... B26B 29/025 7/158

FOREIGN PATENT DOCUMENTS

| | | |
|---|---|---|
| JP | 63163770 | 10/1988 |
| JP | 07037585 | 11/1995 |
| JP | 11009858 | 1/1999 |
| JP | 2005131073 | 5/2005 |

* cited by examiner

*Primary Examiner* — Andrea Wellington
*Assistant Examiner* — Samuel A Davies
(74) *Attorney, Agent, or Firm* — Bacon & Thomas, PLLC

(57) ABSTRACT

A saw sheath is provided which allows a saw to be inserted easily and smoothly, which prevents the inserted saw from easily falling out or rattling in the sheath, and which can suppress scraping-off of the inner wall by the blade tip of the saw caught by the inner wall. Storage structures of the saw sheath and a saw are also provided. The saw sheath (1) includes a flat sheath opening section (10) and a flat main sheath body (20), and a saw blade (41) is inserted into the main sheath body (20) via the sheath opening section (10). A pair of guide rollers (12) are provided at the entrance of the sheath opening section (10), on the left and right sides in the width direction of the entrance, and a grip penetration preventing section (15) is provided in the interior of the sheath opening section (10). The space from the guide rollers (12) to the grip penetration preventing section (15) constitutes an elastic grip-fitting space (16).

10 Claims, 7 Drawing Sheets

(B)

(A)

(C)

(A)

(B)

(A)

(B)

(A)

(B)

SAW SHEATH, AND STORAGE STRUCTURES OF SAW SHEATH AND SAW

TECHNICAL FIELD

The present invention relates to a saw sheath for housing a blade of a saw, and storage structures of the saw sheath and a saw.

BACKGROUND ART

Conventionally, as a saw sheath for housing the blade of a saw such as a hand saw, those using guide rollers have been proposed.

For example, Japanese Utility Model Application Laid-Open No. 7-37585 (Patent Document 1) discloses a saw sheath, wherein rigid roller members (4) are rotatably attached to a sheath body (2) near a saw-body inserting opening (3) thereof, such that when a saw body (1) is put in or taken out of the sheath body (2), the roller members may contact and guide the saw body (1). This configuration facilitates the operations of taking the saw body (1) in and out of the sheath body, and also reduces damages to the sheath body (2).

Further, Japanese Patent Application Laid-Open No. 11-9858 (Patent Document 2) discloses a sheath for a saw or the like, wherein a housing section (2) in a shape capable of accommodating a blade portion (4) of the saw or the like is formed inside a main sheath body (1), and rotary rollers (3) are mounted inside the housing section (2) as well as near an opening thereof through which the blade portion (4) is inserted.

On the other hand, Japanese Patent Application Laid-Open No. 2005-131073 (Patent Document 3) discloses a sheath for a saw or the like, wherein a squeezed portion (3) is formed at an opening (2) on an upper part of the sheath (1), so that a concave portion (5) formed at a saw handle (4) is elastically fitted in and held by the squeezed portion (3) at the opening (2) of the sheath (1). This configuration makes it possible to secure the saw inside the sheath (1) and prevent the saw from unintentionally falling out of the sheath.

Furthermore, Japanese Patent No. 4904442 (Patent Document 4) discloses: the configuration where a sheath opening section (10) is provided with three pairs of first guide rollers (11*a*, 11*a*), second guide rollers (11*b*, 11*b*), and third guide rollers (11*c*, 11*c*) for guiding a saw blade (31) into a saw sheath (1); the configuration where a pair of grip penetration preventing sections (15, 15) in the form of upright posts are arranged behind the pair of first guide rollers (11*a*), each post in parallel with the corresponding roller, to prevent further penetration of a saw grip (32); and the configuration where a sloped guide surface (17) is provided to correct the orientation of a blade tip (31*a*) surface of the saw blade (31).

PRIOR ART DOCUMENTS

Patent Documents

Patent Document 1: Japanese Utility Model Application Laid-Open No. 7-37585

Patent Document 2: Japanese Patent Application Laid-Open No. 11-9858

Patent Document 3: Japanese Patent Application Laid-Open No. 2005-131073

Patent Document 4: Japanese Patent No. 4904442

SUMMARY OF THE INVENTION

Problems to be Solved by the Invention

In the case of the saw sheath disclosed in Patent Document 1 above, however, although the saw body (1) can be effectively guided into the sheath (6), the saw-body inserting opening (3) is made wide so as to facilitate insertion of the saw body (1), which would also make the inserted saw body (1) readily fall out. Particularly, the rigid roller members (4) may guide the saw body in the opposite direction, making the saw body easy to fall out inadvertently.

Further, with the pair of rigid roller members (4) placed merely roughly near the opening, it is not possible to correct the orientation of the blade tip surface that has entered the sheath (6). When the blade tip surface of the saw body (1) is turned and misaligned with respect to the flat surfaces of the hollow inside the sheath (6), the blade tip may contact and damage the sheath inner wall, or the blade tip may be caught by the inner wall, hindering smooth insertion of the saw.

In the case of the sheath for a saw or the like disclosed in Patent Document 2 above, the rollers (3) are disposed on one side inside the main sheath body (1) to allow the blade portion (4) of the saw to move on the rollers. Although this configuration may be able to effectively prevent the sheath from being scraped off by the saw blade, it is not aimed at realizing smooth insertion of the saw from the entrance of the main sheath body (1), and it would not exert such functions and effects.

In the case of the sheath for a saw or the like disclosed in Patent Document 3 above, although the configuration prevents the saw inserted into the sheath (1) from slipping out of the sheath, the elastic fitting between the saw handle (4) and the sheath (1) is merely male/female fitting using the elasticity of a thin resin film; it is not intended for use in combination with rollers. Therefore, although the structure may be used for a while after removal of the package, it is actually a packing container with poor durability, which is easily scraped off by the saw blade and cannot be used repeatedly for a long time.

In the case of the saw sheath disclosed in Patent Document 4 above, it is necessary to form the upright posts as the grip penetration preventing sections (15) behind the first guide rollers (11*a*), making the forming of the sheath opening section (10) complicated and difficult. Further, in the case of the grip penetration preventing section (15) of the post type, if one post is disposed behind one first guide roller (11*a*), the saw grip (32) and the grip penetration preventing section (15) will abut against each other locally at a single position, probably causing rattling. Therefore, it would be necessary to dispose a pair of grip penetration preventing sections (15) on the respective sides. Such a configuration will make the forming of the sheath opening section (10) further complicated and difficult.

In view of the foregoing, an object of the present invention is to solve various problems of the conventional techniques as described above and to provide a saw sheath which allows a saw to be inserted into a sheath entrance easily, which prevents the inserted saw from easily falling out or rattling in the sheath, which allows the blade tip of the saw blade that has entered the sheath to be inserted all the way in smoothly, and which can thus sufficiently suppress scraping-off of the inner wall of the sheath by the saw blade, and also to provide storage structures of the saw sheath and a saw.

Means for Solving the Problems

In order to achieve the above object, a saw sheath according to the present invention has a first feature that it includes a flat sheath opening section and a flat main sheath body continuing from the sheath opening section, a saw blade being inserted, from a blade tip thereof, into the main sheath body through the sheath opening section, wherein the sheath opening section has an opening width that is wider at an entrance thereof and becomes narrower with depth, a pair of guide rollers for guiding the blade tip into an interior of the sheath opening section are provided at the entrance of the sheath opening section, on the left and right sides in a width direction of the entrance, a grip penetration preventing section for preventing further penetration of a saw grip is provided in the interior of the sheath opening section, and a space from the pair of guide rollers to the grip penetration preventing section constitutes an elastic grip-fitting space for receiving a front end section of the saw grip that has moved beyond the pair of guide rollers while being elastically deformed, to cause the saw grip front end section to be fitted and held in the space.

Further, the saw sheath according to the present invention has, in addition to the above-described first feature, a second feature that the grip penetration preventing section is formed using part of an inner wall in the interior of the sheath opening section.

Furthermore, the saw sheath according to the present invention has, in addition to the above-described first or second feature, a third feature that a sloped guide surface is formed on an inner wall in the interior of the sheath opening section, the sloped guide surface serving to guide the saw blade that has entered from the entrance into the interior of the sheath opening section such that the orientation of the saw blade coincides with a flatwise direction of a sheath cavity in the main sheath body, and part of the sloped guide surface constitutes the grip penetration preventing section.

Still further, according to storage structures of a saw sheath and a saw of the present invention, it is the storage structures of the saw sheath having any of the first through third features described above and the saw having a bulging section at a front end section of its saw grip, the bulging section being configured to move beyond the guide roller in the saw sheath while being elastically deformed, wherein when the saw is inserted into the saw sheath, the grip penetration preventing section in the saw sheath prevents penetration of the front end section of the saw grip at the position where the bulging section on the saw grip has moved beyond the guide roller in the saw sheath, so that the front end section of the saw grip is fitted and held in the elastic grip-fitting space, and in the case of taking the saw out of the saw sheath, the bulging section at the front end section of the saw grip that was fitted and held in the elastic grip-fitting space moves beyond the guide roller in the saw sheath in a pull-out direction, while being elastically deformed, so that the saw is pulled out of the saw sheath.

Effects of the Invention

According to the saw sheath recited in claim 1, the saw sheath is made up of the flat sheath opening section and the flat main sheath body continuing from the sheath opening section, and a saw blade is inserted from the sheath opening section into the main sheath body further inside. The sheath opening section has an entrance with a large opening width, and the pair of guide rollers are provided on the respective sides in the width direction of the entrance. Accordingly, the blade tip of the saw blade is readily guided by the guide rollers from the wide entrance into the interior of the sheath opening section and into the main sheath body.

Further, according to the saw sheath recited in claim 1, the grip penetration preventing section is provided in the interior of the sheath opening section. This prevents a saw grip, i.e. the grip of the saw, from further penetrating into the saw sheath, thereby preventing the blade tip of the saw blade from coming into contact with the bottom of the saw sheath.

Particularly, the space from the pair of guide rollers at the entrance of the sheath opening section to the grip penetration preventing section in the interior of the sheath opening section constitutes the elastic grip-fitting space for receiving a front end section of the saw grip that has moved beyond the guide rollers while being elastically deformed, to cause the saw grip front end section to be fitted and held in the space.

Therefore, in the case of inserting the saw into the saw sheath, the saw grip front end section that moved beyond the guide rollers while being elastically deformed and was stopped by the grip penetration preventing section is fitted in the elastic grip-fitting space in the state where it is sandwiched between the pair of guide rollers and the grip penetration preventing section, and is held in that position.

On the other hand, in the case of taking the saw out of the saw sheath, an operator may hold the saw grip and pull it in the pull-out direction, which causes the saw grip front end section that was held in the elastic grip-fitting space to move beyond the guide rollers, while being elastically deformed, so that the fitting of the saw grip front end section is released, whereby the saw is taken out of the sheath.

Needless to say, in the case of inserting the saw into or taking the saw out of the saw sheath, the rotation of the guide rollers can further facilitate the inserting or taking-out operation accompanied by the elastic deformation of the saw grip.

Therefore, according to the invention recited in claim 1, it is easy to insert the saw at the sheath entrance, and the inserted saw would not easily fall out of the sheath or rattle therein. Further, the blade tip of the saw blade can be guided and inserted into the saw sheath smoothly, so that the scraping-off of the inner wall of the saw sheath by the saw blade can be suppressed sufficiently.

According to the saw sheath recited in claim 2, in addition to the functions and effects obtained by the configuration recited in claim 1 as described above, the grip penetration preventing section is formed by using part of the inner wall in the interior of the sheath opening section.

It is unnecessary to add another member to form the grip penetration preventing section. Rather, it can be formed by merely considering the shape of the inner wall in the interior of the sheath opening section. This can reduce the number of components as well as assembly man-hour.

According to the saw sheath recited in claim 3, in addition to the functions and effects obtained by the configuration recited in claim 1 or 2 as described above, the sloped guide surface is formed on the inner wall in the interior of the sheath opening section, for guiding the saw blade that has entered from the entrance into the interior of the sheath opening section such that the orientation of the saw blade coincides with the flatwise direction of the sheath cavity in the main sheath body, and part of the sloped guide surface serves as the grip penetration preventing section.

With this configuration, when the blade tip of the saw blade enters into the sheath opening section, it is readily possible to correct the orientation of the flat blade tip to match the flatwise direction of the sheath cavity in the main sheath body, while guiding the blade tip on the sloped guide surface. This ensures that the blade tip can be guided and inserted from the sheath opening section into the main sheath body smoothly without problems.

In addition, as the grip penetration preventing section is part of the sloped guide surface, the front end section of the saw grip that has entered into the sheath opening section following the saw blade can be reliably stopped by the part of the sloped guide surface, with the corrected orientation of the saw blade being maintained in the flatwise direction of the sheath cavity.

According to the storage structures of the saw sheath and the saw recited in claim 4, the saw sheath is the one having any of the first through third features described above, and the saw has the bulging section at the saw grip front end section, the bulging section being configured to move beyond the guide roller in the saw sheath while being elastically deformed. When the saw is inserted into the saw sheath, the grip penetration preventing section in the saw sheath prevents penetration of the saw grip front end section at the position where the bulging section on the saw grip has moved beyond the guide roller in the saw sheath, whereby the saw grip front end section is fitted and held in the elastic grip-fitting space. In the case of taking the saw out of the saw sheath, the bulging section at the saw grip front end section that was fitted and held in the elastic grip-fitting space moves beyond the guide roller in the saw sheath in the pull-out direction, while being elastically deformed, whereby the saw is pulled out of the saw sheath.

With this configuration, the saw blade can be quickly inserted into the saw sheath from the sheath opening section, and further into the main sheath body smoothly, without being caught by the inner wall. This can also sufficiently suppress scraping-off of the inner wall of the sheath by the saw blade.

Then, at the position where the saw grip has entered into the interior of the sheath opening section in the saw sheath, the saw grip is reliably fitted and held in the elastic grip-fitting space. This prevents the inserted saw from inadvertently falling out of the saw sheath or rattling in the sheath.

In the case of taking the saw out of the saw sheath as well, the saw grip front end section is elastically pulled out, accompanied by the rotation of the guide rollers, whereby the saw can be pulled out sufficiently smoothly.

MODES FOR CARRYING OUT THE INVENTION

Figure 1:
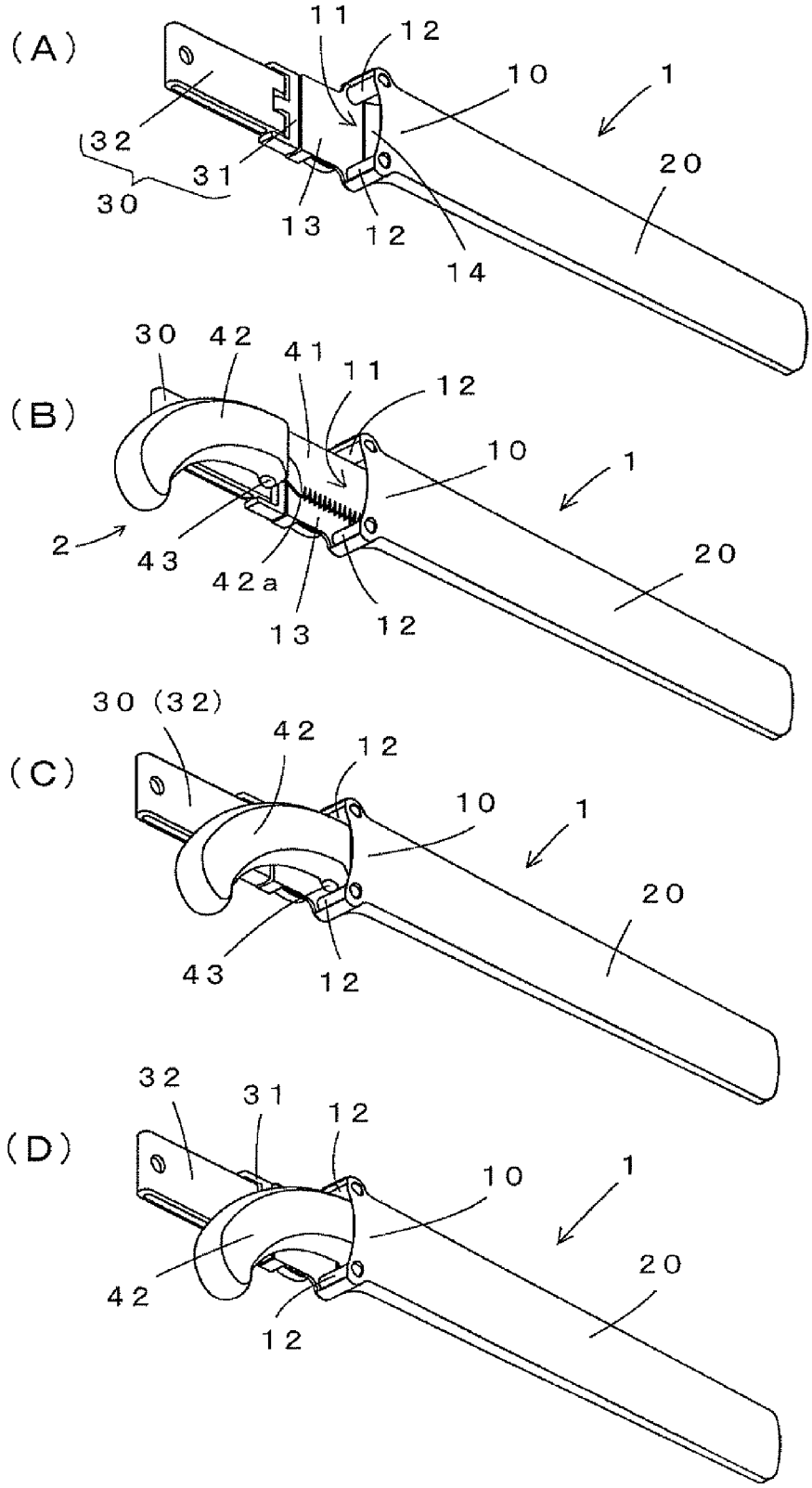
FIG. 1 shows perspective views of a saw sheath and a saw according to an embodiment of the present invention, wherein (A) is a perspective view of the saw sheath alone, and (B) to (D) are perspective views showing stages of insertion of the saw into the saw sheath.

A saw sheath according to an embodiment of the present invention will be described with reference to the following drawings.

Referring first to FIG. 1(A) to (D), a saw sheath 1 is made up of a sheath opening section 10 and a main sheath body 20. A suspending portion 30 can be detachably attached to the sheath opening section 10.

A saw 2 is removably inserted into the saw sheath 1.

An operator may take the saw 2 out of the saw sheath 1, when necessary, and put it in the saw sheath 1 again when finishing the operation.

The operator can use the suspending portion 30 to secure the saw sheath 1 to the waist, for example.

Referring to FIG. 2(A) to (C) as well, each of the sheath opening section 10 and the main sheath body 20 of the saw sheath 1 is a flat tubular body. While the sheath opening section 10 and the main sheath body 20 are continuously formed in one piece, they may be formed in separate pieces and joined together to form the saw sheath 1.

The sheath opening section 10 has an opening width that is wider at an entrance 11 and becomes narrower in the depth direction of the interior.

The entrance 11 of the sheath opening section 10 is a flattened opening, and a pair of guide rollers 12 are rotatably provided on the left and right sides in the width direction (longer direction) of the flattened entrance 11. The pair of guide rollers 12 have their rotation axes in the direction (shorter direction of the entrance) perpendicular to the width direction (longer direction) of the entrance 11, and serve to guide a blade tip 41*a* of the saw 2 (see FIG. 3(A)) that is being inserted, smoothly into the entrance 11 of the sheath opening section 10.

Figure 3:
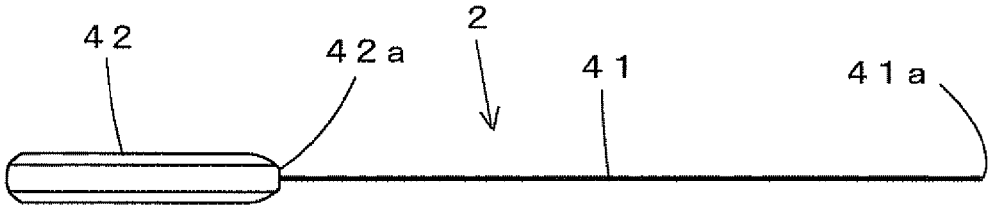
FIG. 3 shows the saw according to the embodiment of the present invention, wherein (A) is a front view, (B) is a top plan view, and (C) is a bottom plan view.
Figure 3:
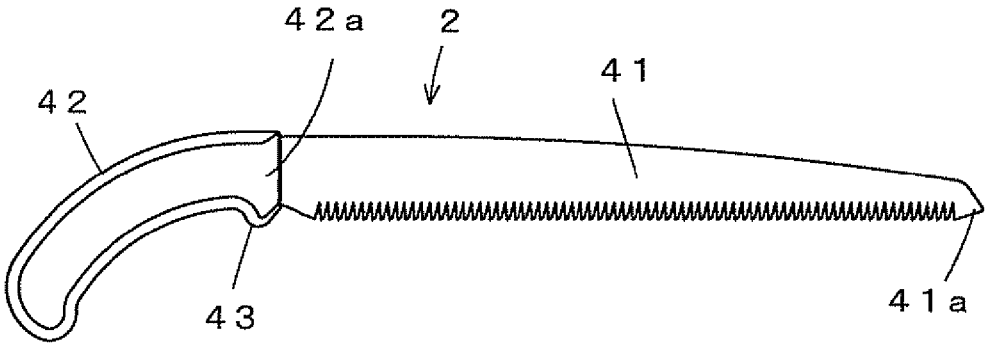
Figure 3:
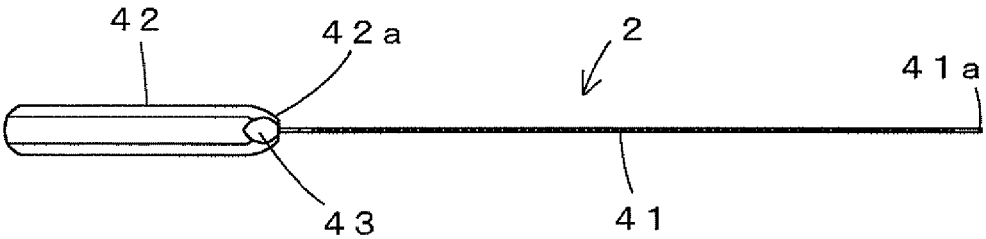

Referring to FIG. 3 as well, the saw 2 includes a saw blade 41, the blade tip 41*a*, and a saw grip 42.

At a front end section 42*a* of the saw grip, a bulging section 43 is provided. The saw grip 42, including the bulging section 43, may be formed of elastic rubber, plastic, or other material. At least the bulging section 43 is formed of an elastically deformable material. The saw grip 42 and the bulging section 43 at its front end section 42*a* are formed in one piece, although they do not necessarily have to be formed integrally.

In the sheath opening section 10 of the saw sheath 1, a blade tip receiving board 13 is provided for receiving and guiding the blade tip 41*a* of the saw 2 to the entrance 11. The blade tip receiving board 13 is in flush with the entrance 11 and extends to protrude from the entrance 11. When the saw 2 is to be inserted into the saw sheath 1, the blade tip 41*a* of the saw 2 first touches the blade tip receiving board 13, moves forward while being guided on the blade tip receiving board 13 to reach the guide rollers 12, and then it is guided by the guide rollers 12 quickly into the entrance 11.

A portion of the blade tip receiving board 13 from its distal end toward the back side is used to detachably fit the suspending portion 30 thereto.

The suspending portion 30 is made up of a fitting claw section 31, to be fitted with the blade tip receiving board 13, and a suspender strap 32.

The main sheath body 20 is a long and thin, flat tubular body having a flat sheath cavity 21 inside it (see FIGS. 4 to 7).

The sheath cavity 21 is configured to continue smoothly to the interior and the entrance 11 of the sheath opening section 10.

The distal end of the main sheath body 20 may be left open, or closed. The length of the main sheath body 20, its width (length in the longer diameter direction of the flat oval cross section), and its thickness (length in the shorter diameter direction of the flat oval cross section) are each preferably set as short as possible within the range capable of housing the saw blade, for reduction in weight.

In the case of forming the main sheath body 20 and the sheath opening section 10 in one piece, they are preferably formed by synthetic resin. In the case of forming the main sheath body 20 and the sheath opening section 10 in separate pieces, the main sheath body 20 may be formed of light metal such as aluminum, or other materials besides synthetic resin.

Figure 5:
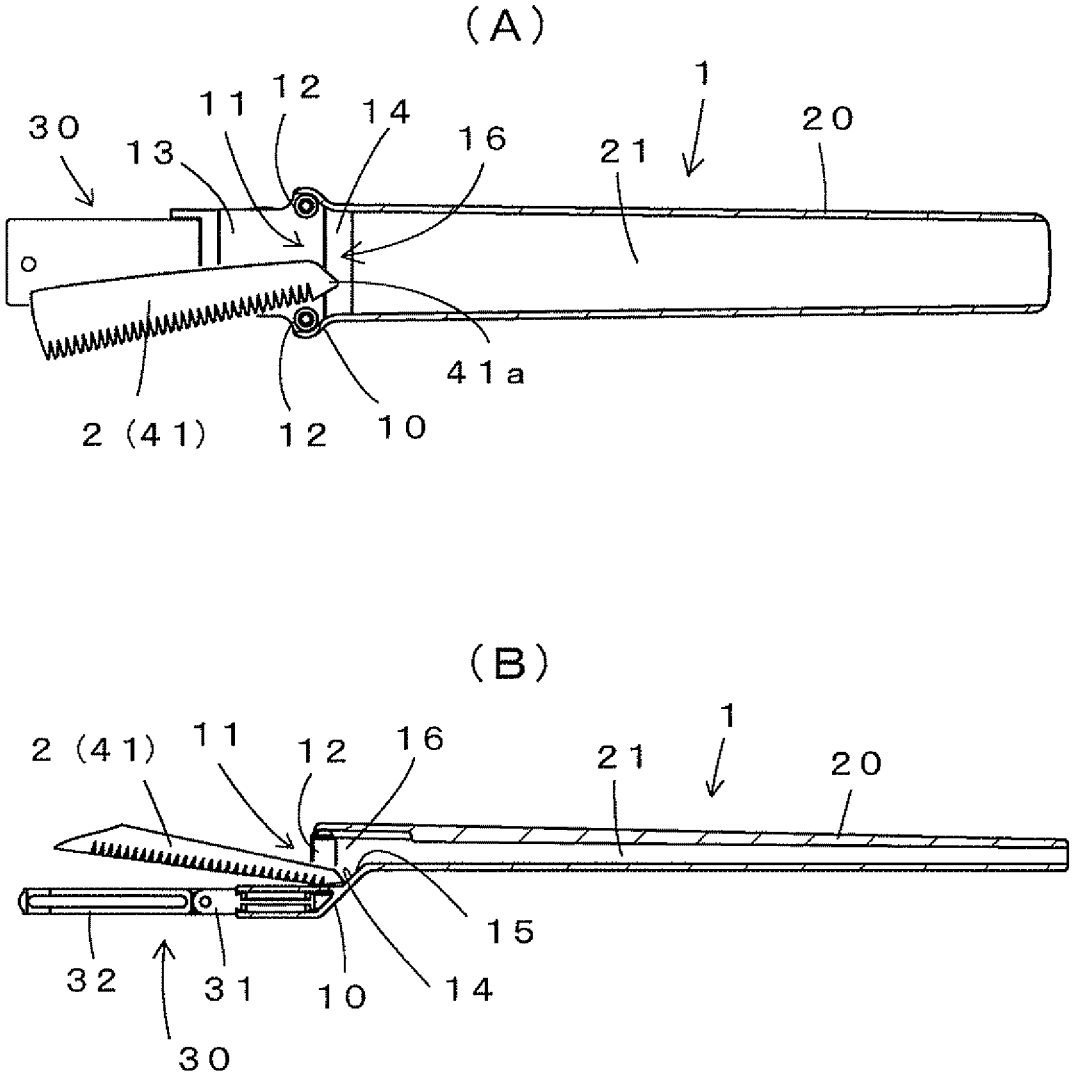
FIG. 5 illustrates a second stage of insertion of the saw into the saw sheath according to the embodiment of the present invention, wherein (A) is a horizontal cross-sectional view, and (B) is a vertical cross-sectional view.

Referring to FIG. 2(D) and FIG. 5 as well, the sheath opening section 10 is provided with a sloped guide surface 14, a grip penetration preventing section 15, and an elastic grip-fitting space 16 in the interior of the entrance 11.

The sloped guide surface 14 is formed to make the orientation of the blade tip 41*a* of the saw blade 41, which has entered from the entrance 11 into the interior of the sheath opening section 10, coincide with the flatwise direction of the sheath cavity 21 of the main sheath body 20.

The slope of the sloped guide surface 14 starts at the position slightly behind the guide rollers 12 at the entrance 11 of the sheath opening section 10, and extends to reach the sheath cavity 21 of the main sheath body 20 (to reach a longer diameter side of the flat sheath cavity 21).

While the sloped guide surface 14 is provided on one of the longer diameter sides of the flat interior of the sheath opening section 10 in the present embodiment, two sloped guide surfaces may be provided on both longer diameter sides facing each other.

As the blade tip 41*a* of the saw blade 41 that has passed the pair of guide rollers 12 comes into contact with and is guided by the sloped guide surface 14, the blade is inserted into the sheath cavity 21, with the orientation of the blade tip 41*a* surface being corrected to coincide with the flatwise direction of the sheath cavity 21.

The grip penetration preventing section 15 is for preventing the saw grip 42, which has entered from the entrance 11 to the interior of the sheath opening section 10, from penetrating beyond a certain position.

More specifically, the grip penetration preventing section 15 may be formed by using part of the inner wall in the interior of the sheath opening section 10. That is, the inner wall in the interior of the sheath opening section 10 may be, for example, partially protruded to form the grip penetration preventing section 15, such that the saw grip front end section 42*a* is caught by the grip penetration preventing section 15 and no longer able to penetrate further inside.

In practice, part of the sloped guide surface 14 formed in the interior of the sheath opening section 10 is used as it is as the grip penetration preventing section 15. With the presence of the sloped guide surface 14, the opening size inside the sheath opening section 10 gradually decreases toward the sheath cavity 21. When the opening size of the interior becomes smaller than the outer size of the saw grip front end section 42*a*, penetration of the saw grip front end section 42*a* is prevented. In this manner, the part of the sloped guide surface 14 where the opening size inside the sheath opening section 10 becomes smaller than the outer shape of the saw grip front end section 42*a* serves as the grip penetration preventing section 15.

The elastic grip-fitting space 16 (see FIG. 4) is a space in the interior of the sheath opening section 10 between the guide rollers 12 and the grip penetration preventing section 15. In the elastic grip-fitting space 16, the saw grip front end section 42*a* abuts against the grip penetration preventing section 15, and the bulging section 43 on the saw grip 42 is in the state where it has just moved beyond a guide roller 12 while being elastically deformed. In other words, the saw grip front end section 42*a* is received by, and is fitted and held in, the elastic grip-fitting space 16 as it is sandwiched between the grip penetration preventing section 15 and the guide rollers 12. The bulging section 43 that has moved beyond the guide roller 12, while being elastically deformed, is stopped at the position where it has just moved beyond the roller. Therefore, the bulging section 43 is held in the state where it is in contact with, and elastically fitted to, a part of the guide roller 12. Accordingly, the saw grip front end section 42*a* is held in the elastic grip-fitting space 16, without rattling.

That is, the elastic grip-fitting space 16 is the space where the saw grip front end section 42*a* is elastically fitted.

In the case of inserting the saw 2 into the sheath opening section 10, at the position where the bulging section 43 has just moved beyond the guide roller 12, the grip penetration preventing section 15 prevents further penetration of the saw grip front end section 42*a*. This results in the saw grip 42 elastically fitted and held in position.

On the other hand, in the case of taking the saw 2 out of the saw sheath 1, when an operator grabs and pulls the saw grip 42, the bulging section 43 that was in the elastic grip-fitting space 16 moves beyond the guide roller 12 while being elastically deformed. This releases the fitting of the saw grip front end section 42*a* in the elastic grip-fitting space 16, so that the saw 2 is pulled out of the sheath opening section 10.

Referring to FIGS. 4 to 7 as well, an operation and function of inserting the saw 2 into the saw sheath 1 will be described.

Figure 2:
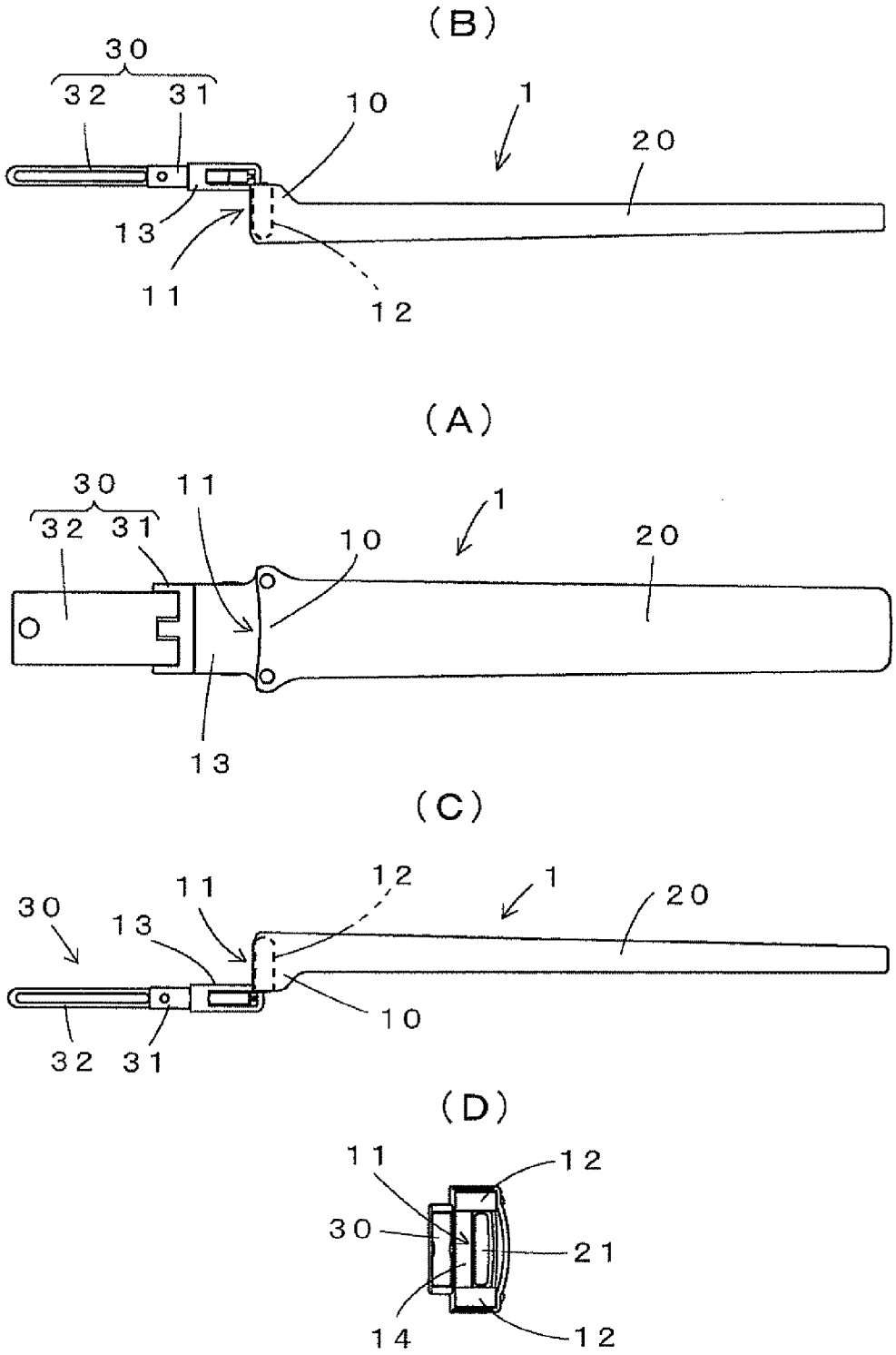
FIG. 2 shows the saw sheath according to the embodiment of the present invention, wherein (A) is a front view, (B) is a top plan view, (C) is a bottom plan view, and (D) is a right side view.
Figure 4:
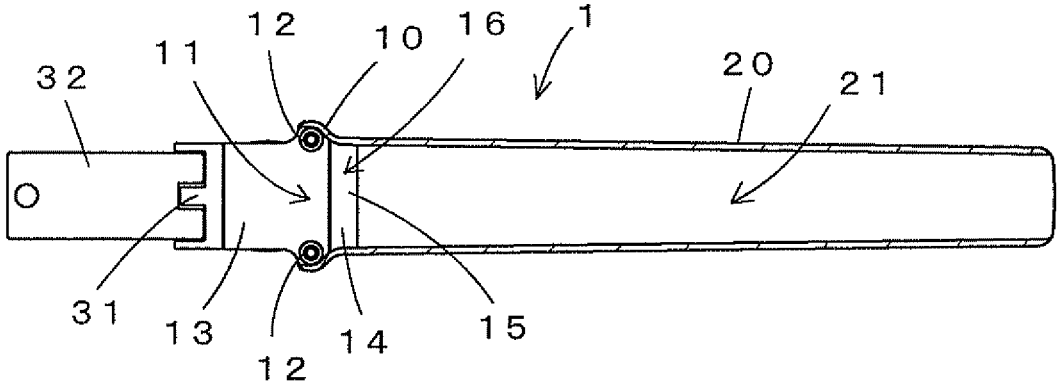
FIG. 4 illustrates a first stage of insertion of the saw into the saw sheath according to the embodiment of the present invention, wherein (A) is a horizontal cross-sectional view, and (B) is a vertical cross-sectional view.
Figure 4:
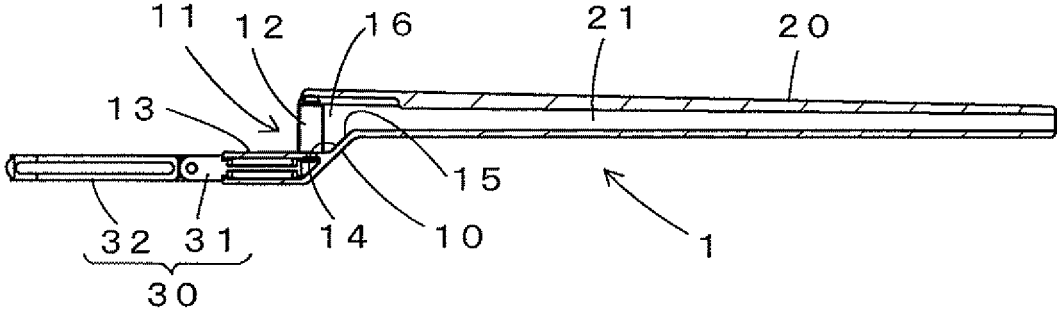

It is here assumed that the saw 2 shown in FIG. 3 is to be inserted into the empty saw sheath 1 shown in FIGS. 2 and 4. With an inserting operation by an operator, the blade tip 41*a* of the saw 2 first comes into contact with the blade tip receiving board 13, as shown in FIG. 5, and the blade tip 41*a* slides on the surface of the blade tip receiving board 13 toward the entrance 11. As the blade tip 41*a* enters the spacing between the pair of guide rollers 12, 12 disposed on the left and right sides in the width direction of the entrance 11 of the sheath opening section 10, the saw blade 41 comes into contact with one of the pair of guide rollers 12, 12, and is quickly guided to the inside by the guide roller 12. At this time, as the guide roller 12 is freely rotatably held, when the saw blade 41 abuts against the guide roller 12 in the direction in which the saw blade 41 enters (penetrates) the saw sheath 1, the guide roller 12 starts rotating to thereby smoothly guide the saw blade 41 into the entrance 11.

The spacing between the pair of guide rollers 12, 12 may be set equal to, or slightly greater than, or slightly smaller than the size in the width direction (longer direction) of the sheath cavity 21 of the main sheath body 20. Such a design ensures that the blade tip 41*a* is reliably guided into the spacing in the width direction (longer direction) of the sheath cavity 21 of the main sheath body 20, irrespective of the angle in which the saw 2 is guided by the guide roller 12.

When the blade tip 41*a* of the saw 2 reaches the sloped guide surface 14, the blade tip 41*a* is guided by the sloped surface of the sloped guide surface 14 toward the sheath cavity 21 of the main sheath body 20. The size of the sheath cavity 21 in the direction (shorter direction) perpendicular to its width direction (longer direction) is smaller than the size in the shorter direction of the entrance 11 of the sheath opening section 10 (i.e. flatter than the entrance 11). Accordingly, as the blade tip 41*a* and the following saw blade 41 are guided on the sloped guide surface 14, their orientation is corrected to coincide with the flatwise direction of the sheath cavity 21.

Figure 6:
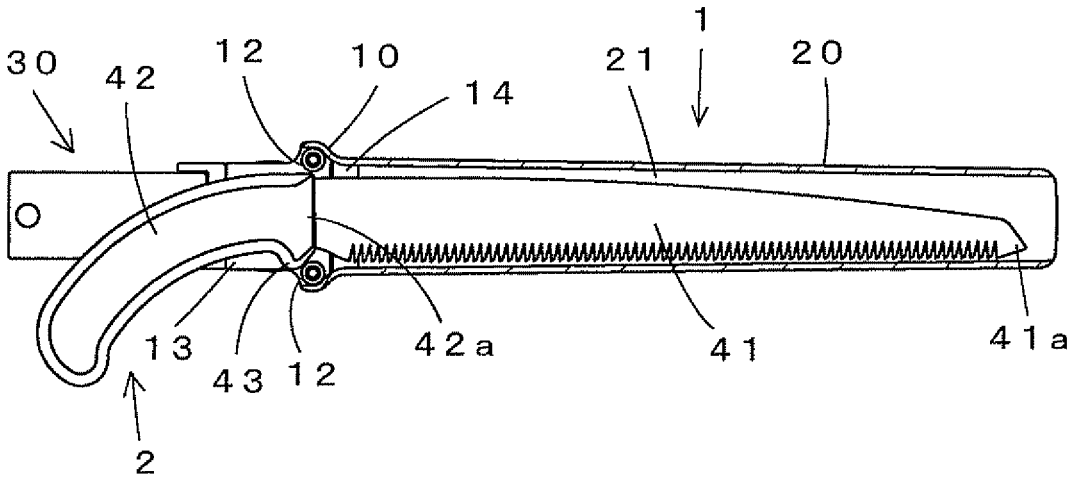
FIG. 6 illustrates a third stage of insertion of the saw into the saw sheath according to the embodiment of the present invention, wherein (A) is a horizontal cross-sectional view, and (B) is a vertical cross-sectional view.
Figure 6:
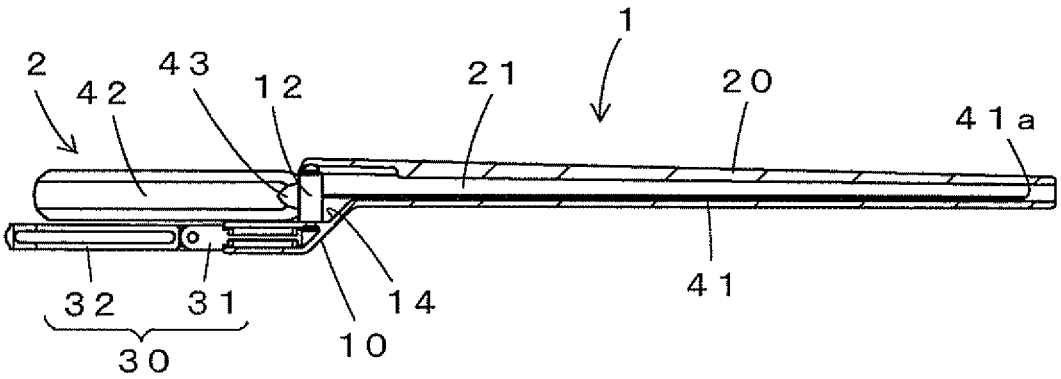

Referring to FIG. 6 as well, when the saw blade 41 of the saw 2 enters deep inside the main sheath body 20, the saw grip front end section 42*a* lastly reaches the entrance 11 of the sheath opening section 10, and the bulging section 43 provided at the saw grip front end section 42*a* reaches the pair of guide rollers 12. With the presence of the bulging section 43, the saw grip front end section 42*a* is once caught by the guide rollers 12.

In the state where the saw grip front end section 42*a* is caught by the pair of guide rollers 12, when the operator applies further force in the direction of inserting the saw 2, the bulging section 43 moves beyond a guide roller 12 while being elastically deformed. At this time, the guide roller 12 rotates, which allows the bulging section 43 to smoothly move beyond the roller.

Figure 7:
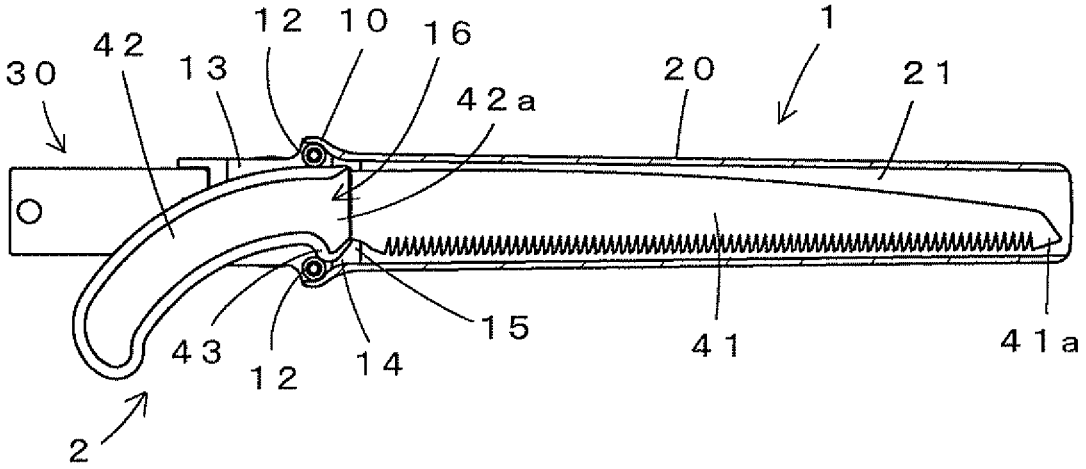
FIG. 7 illustrates a fourth stage of insertion of the saw into the saw sheath according to the embodiment of the present invention, wherein (A) is a horizontal cross-sectional view, and (B) is a vertical cross-sectional view.
Figure 7:
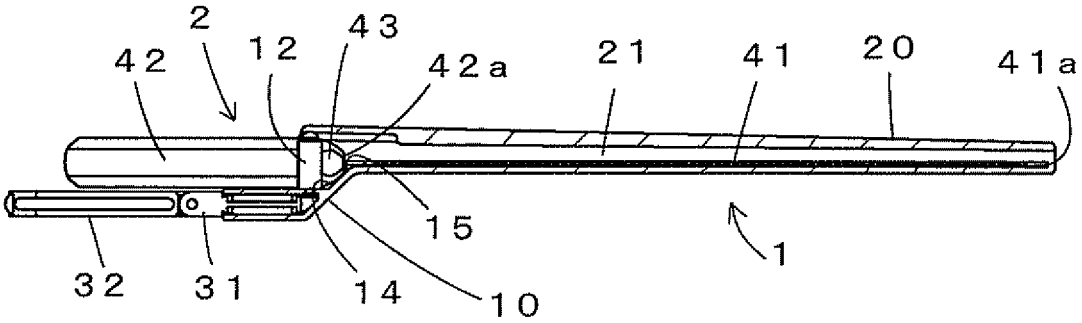

Referring to FIG. 7 as well, at the position where the bulging section 43 has just moved beyond the guide roller 12, further penetration of the saw grip front end section 42*a* is prevented by the grip penetration preventing section 15 which is formed as part of the sloped guide surface 14 at the intermediate position of the guide surface 14. This causes the grip front end section 42*a* to be fitted and held in the elastic grip-fitting space 16 which is the space between the grip penetration preventing section 15 and the pair of guide rollers 12, 12. At this time, the bulging section 43 has its rear side in contact with the guide roller 12 in the elastically deformed state. Therefore, the grip front end section 42*a* is stationary as it is elastically fitted in the elastic grip-fitting space 16. As such, the saw 2 is held without rattling.

An operation and function of taking the saw 2 out of the saw sheath 1 will now be described.

In the state shown in FIG. 7, i.e. in the state where the saw 2 (the saw blade 41) is housed in the saw sheath 1, the operator grabs and pulls the saw grip 42 in the direction in which the saw is taken out of the saw sheath 1. With this pulling operation, the bulging section 43 on the saw grip 42 moves beyond the guide roller 12 in the pull-out direction, while being elastically deformed. As the guide roller 12 rotates at this time, the bulging section 43 moves beyond the roller smoothly. As such, the saw 2 can be pulled out easily.

INDUSTRIAL APPLICABILITY

The saw sheath according to the present invention has an industrial application, together with a saw, as a sheath for housing the saw.

DESCRIPTION OF THE REFERENCE CHARACTERS

1 saw sheath
2 saw
10 sheath opening section
11 entrance
12 guide roller
13 blade tip receiving board
14 sloped guide surface
15 grip penetration preventing section
16 elastic grip-fitting space
20 main sheath body
21 sheath cavity
30 suspending portion
31 fitting claw section
32 suspender strap
41 saw blade
41*a* blade tip
42 saw grip
42*a* saw grip front end section
43 bulging section

What is claimed is:

1. In combination, a saw sheath including a flat sheath opening section and a flat main sheath body continuing from the sheath opening section, and a saw including a saw blade inserted from a blade tip thereof, into the main sheath body through the sheath opening section and a saw grip distal from the tip, wherein the sheath opening section has an opening width that is wider at an entrance thereof and becomes narrower with depth, a pair of guide rollers for guiding the blade tip into an interior of the sheath opening section are provided at the entrance of the sheath opening section, on left and right sides in a width direction of the entrance, a grip penetration preventing section for preventing further penetration of the saw grip is provided in the interior of the sheath opening section, and a space from the pair of guide rollers to the grip penetration preventing section constitutes an elastic grip-fitting space for receiving a front end section of the saw grip that has moved beyond the pair of guide rollers while being elastically deformed, to cause the saw grip front end section to be fitted and held in the space, and the saw grip has a bulging section, formed of an elastically deformable material, provided on the front end section of the saw grip, the saw grip and the bulging section are monolithic, and the bulging section is configured to move beyond the guide rollers by a rotation of the guide rollers in the saw sheath while being elastically deformed, so that the front end section of the saw grip is fitted and held in the elastic-fitting space when the saw is inserted into the saw sheath and only the section of the saw grip that fits inside the saw sheath is deformed, and in case of taking the saw out of the sheath, the front end section of the saw grip that was fitted and held in the elastic-fitting space is moved beyond the guide roller when the saw is pulled away.

2. The saw sheath combination according to claim 1, wherein the grip penetration preventing section is formed using part of an inner wall in the interior of the sheath opening section.

3. The saw sheath combination according to claim 2, wherein a sloped guide surface is formed on an inner wall in the interior of the sheath opening section, the sloped guide surface serving to guide the saw blade that has entered from the entrance into the interior of the sheath opening section such that the orientation of the saw blade coincides with a flatwise direction of a sheath cavity in the main sheath body, and part of the sloped guide surface constitutes the grip penetration preventing section.

4. The saw sheath combination according to claim 3, wherein when the saw is inserted into the saw sheath, the grip penetration preventing section in the saw sheath prevents penetration of the front end section of the saw grip at the position where the bulging section on the saw grip has moved beyond the guide roller in the saw sheath, so that the front end section of the saw grip is fitted and held in the elastic grip-fitting space.

5. The saw sheath combination according to claim 2, wherein when the saw is inserted into the saw sheath, the grip penetration preventing section in the saw sheath prevents penetration of the front end section of the saw grip at the position where the bulging section on the saw grip has moved beyond the guide roller in the saw sheath, so that the front end section of the saw grip is fitted and held in the elastic grip-fitting space.

6. The saw sheath combination according to claim 1, wherein a sloped guide surface is formed on an inner wall in the interior of the sheath opening section, the sloped guide surface serving to guide the saw blade that has entered from the entrance into the interior of the sheath opening section such that the orientation of the saw blade coincides with a flatwise direction of a sheath cavity in the main sheath body, and part of the sloped guide surface constitutes the grip penetration preventing section.

7. The saw sheath combination according to claim 6, wherein when the saw is inserted into the saw sheath, the grip penetration preventing section in the saw sheath prevents penetration of the front end section of the saw grip at the position where the bulging section on the saw grip has moved beyond the guide roller in the saw sheath, so that the front end section of the saw grip is fitted and held in the elastic grip-fitting space.

8. The saw sheath combination according to claim 1, wherein the elastically deformable material is elastic rubber or plastic.

9. The saw sheath combination according to claim 8, wherein the elastically deformable material is elastic rubber.

10. The saw sheath combination according to claim 8, wherein the elastically deformable material is plastic.

* * * * *